US007407115B2

(12) United States Patent
Laidler

(10) Patent No.: US 7,407,115 B2
(45) Date of Patent: Aug. 5, 2008

(54) NOZZLE ARRANGEMENT

(75) Inventor: Keith Laidler, Stourbridge (GB)

(73) Assignee: Incro Limited, Stourbridge (GB)

( * ) Notice: Subject to any disclaimer, the term of this patent is extended or adjusted under 35 U.S.C. 154(b) by 527 days.

(21) Appl. No.: 10/493,478

(22) PCT Filed: Oct. 23, 2002

(86) PCT No.: PCT/GB02/04772

§ 371 (c)(1),
(2), (4) Date: Aug. 30, 2004

(87) PCT Pub. No.: WO03/035268

PCT Pub. Date: May 1, 2003

(65) Prior Publication Data

US 2006/0231557 A1 Oct. 19, 2006

(30) Foreign Application Priority Data

Oct. 24, 2001 (GB) ..... 0125487.9
Jul. 19, 2002 (GB) ..... 0216812.8

(51) Int. Cl.
*B05B 1/28* (2006.01)
*A62C 31/02* (2006.01)

(52) U.S. Cl. ..... 239/119; 239/120; 239/115; 239/337; 239/600; 239/601

(58) Field of Classification Search ..... 239/104, 239/106, 114, 115, 123, 451–453, 600, 602, 239/333, 337
See application file for complete search history.

(56) References Cited

U.S. PATENT DOCUMENTS 4,253,609 A * 3/1981 Laauwe ..... 239/327
5,263,616 A * 11/1993 Abplanalp ..... 222/402.13
5,743,468 A 4/1998 Laidler ..... 239/115
5,743,469 A * 4/1998 Reintanz ..... 239/518
5,927,604 A * 7/1999 Laidler ..... 239/104
6,367,711 B1 * 4/2002 Benoist ..... 239/115

FOREIGN PATENT DOCUMENTS

WO WO 01/89958 A2 11/2001

* cited by examiner

*Primary Examiner*—Dinh Q. Nguyen
*Assistant Examiner*—James S. Hogan
(74) *Attorney, Agent, or Firm*—Pillsbury Winthrop Shaw Pittman LLP

(57) ABSTRACT

The present invention relates to improvements in or relating to a nozzle arrangement. Th nozzle arrangement of the present invention are adapted to be fitted to a container and actuate the release of the contents stored in the container. The nozzle arrangement has a body (101) which comprises an outlet through which, in use, fluid is ejected from the nozzle arrangement and is formed from at least a first part (102) and a second part (103), the first part having an inlet (120) through which the contents of the container admit fluid into the nozzle arrangement during use and an abutment surface (105) which contact an abutment surface (106) of the second part. The abutment surface (105,106) of the first and second parts define a fluid flow passageway (122,123) therebetween, which connects the inlet (120) to the outlet (124), as well as a seal that is adapted to contain any fluid that leaks from the inlet and/or at least a portion of the fluid flow passage (122, 123) during use. The seal is formed by a recessed formation (203,204) disposed in one of said abutment surfaces (105, 106) and a corresponding projection formation (201,202) disposed on the opposing surface which is adapted to be received within, and form a sealing engagement with, the recessed formation (203,204). The seal defines an internally sealed compartment between said abutment surfaces which extends around said inlet and at least a portion of the fluid flow passageway.

15 Claims, 3 Drawing Sheets

NOZZLE ARRANGEMENT

CROSS REFERENCE TO RELATED APPLICATIONS

This is the U.S. National Phase of PCT/GB02/04772, filed Oct. 23, 2002, which in turn claims priority to British application No. 0125487.5, filed Oct. 24, 2001, and British application No. 0216812.8, filed Jul. 19, 2002, both of which are incorporated herein in their entirety by reference.

The present invention relates to improvements in or relating to a nozzle arrangement.

Nozzles are used in a wide range of different devices, including, for example, industrial, pharmaceutical/medical and domestic/household devices, to control the ejection of fluids from a pressurised fluid source. The fluid source is commonly a pressurised fluid-filled container, such as a so-called "aerosol canister". In some cases, however, the container is non-pressurised and fluid is forced through and ejected from the nozzle by the actuation of a manually operable "pump" or "trigger", which forms part of the nozzle device.

Nozzles are also commonly used to generate sprays for use in a wide range of applications and in a wide range of commercially available products, such as antiperspirant sprays, deodorant sprays, perfumes, air fresheners, antiseptics, paints, insecticides, polish, hair care products, pharmaceuticals, water, lubricants etc.

It is known to use nozzle arrangements formed from two or more component parts that are fixed together to provide the final operable nozzle arrangement. An example of such a nozzle arrangement is described in WO 97/31841, the entire contents of which are incorporated herein by reference. The nozzle arrangements described in WO 97/31841 comprise a body having two parts, each part having an abutment surface which is movable between an open position, in which the abutment surfaces are separated from one another, and a closed position in which the abutment surfaces are in contact. In the closed position, the abutment surfaces of the two parts define therebetween a fluid inlet which, during use, receives fluid from a pressurised fluid supply source; a fluid outlet, through which, in use, fluid is ejected from the nozzle arrangement; and a fluid flow passage, through which fluid flows from the fluid inlet to the outlet. To ensure that a tight contact between the abutment surfaces of the two parts of the body is maintained during use, each part has formations that engage with corresponding formations on the other surface to hold the two parts together. This nozzle arrangement has particular advantages because the two parts of the body can be separated to expose the abutment surfaces of each respective part to facilitate cleaning.

However, a problem with such nozzle arrangements is that fluid can escape from either the fluid inlet or the fluid flow passage during use and then seep between the abutment surfaces of the two component parts. Ultimately, this results in fluid leaking out of the nozzle arrangement. To minimise the leakage of fluid, the nozzle arrangements described in WO 97/31841 comprise a seal positioned between the abutment surfaces of the two component parts. This seal is known as a "horseshoe" seal (due to its horseshoe shape). The two ends of the horseshoe are positioned on either side of the fluid outlet and the seal extends between these two ends and encircles the fluid inlet and the fluid flow passage which is defined by the abutment surfaces. The horseshoe seal is formed from the combination of a horseshoe shaped ridge or protrusion provided on the abutment surface of one of the parts of the body and a correspondingly shaped recess defined on the opposing abutment surface of the other part. When the two parts are connected together, the horseshoe-shaped ridge or protrusion is received within the horseshoe shaped recess and this forms a seal barrier which prevents any fluid that has escaped from the fluid flow passage or the fluid inlet from seeping between the abutment surfaces and leaking out of the sides and the rear of the nozzle. In addition, the seal can also assist in holding the two parts of the nozzle arrangement tightly together to minimise the chance of fluid leakage.

However, whilst this seal is effective in minimising the leakage of fluid from the sides and the rear of the nozzle arrangement, it is still possible for any fluid that has escaped from the fluid inlet and/or fluid flow passage and seeped between the abutment surfaces of the two parts, to leak out of the front of the nozzle arrangement in the region between the two ends of the "horseshoe" shaped seal (i.e. on either side of the fluid outlet). The leakage of fluid in this manner can be particularly disadvantageous for a number of reasons. Firstly, the total flow of fluid through the nozzle is increased which means that the nozzle arrangement is not ejecting fluid at the predetermined and desired volume. Secondly, as a consequence of the increased flow, the pressure in the fluid flow passage is decreased. This decreased pressure, together with the leakage of fluid from the nozzle in the vicinity of the fluid flow outlet, can significantly affect the size of spray droplets ejected from the nozzle and hence, the quality of the spray produced.

A further problem caused by the leakage of fluid from the fluid flow passage occurs in nozzle arrangements where the fluid flow passage additionally comprises a number of internal features, which serve to modify and/or control the properties of the spray ejected from the nozzle arrangement. Examples of such internal features include:

(i) one or more inner orifices adapted to generate a spray within the fluid flow passageway;
(ii) one or more expansion chambers;
(iii) one or more swirl chambers;
(iv) one or more venturi chambers; and
(v) one or more sections where the fluid flow passage is divided into one of more separate channels.

Further details about each of the above-identified internal features, which may be present in the fluid flow passage in a multitude of different combinations, and the effect on the properties of the spray that each feature imparts, is described in more detail in the Applicant's co-pending International Patent Application Publication No. WO 01/89958, the entire contents of which are incorporated herein by reference.

In such nozzle arrangements, the leakage of fluid at any position along the length and the subsequent seepage of the leaked fluid between the abutment surfaces can result in fluid leaking into and flooding other internal features present in the fluid flow passage. Once an internal feature becomes flooded, it will not then function properly and hence, the properties of the spray ejected from the nozzle arrangement (such as the droplet size distribution and the size and shape of the spray cone) can be adversely affected. In particular, if the internal features include a inner orifice which is adapted to generate a spray internally within the nozzle, then flooding the fluid flow passage downstream of the inner orifice will prevent the formation of spray within the fluid flow passage as intended.

It is an object of the present invention, therefore, to provide an improved nozzle arrangement which is composed of two or more parts connected together in which the leakage of fluid from the nozzle arrangement is either minimised or eliminated altogether.

According to an aspect of the present invention there is provided a nozzle arrangement adapted to be fitted to a container to actuate the release of the contents stored in the container, said nozzle arrangement having a body comprising an outlet through which the contents of the container are ejected from the nozzle arrangement during use; said body being formed from at least a first and a second part, the first part having an inlet through which the contents of the container access the arrangement during use and an abutment surface which contacts an abutment surface of the second part, said abutment surfaces defining a fluid flow passage therebetween that connects the inlet to the outlet and a seal that is adapted to contain any fluid that leaks from the inlet and/or at least a portion of the fluid flow passage and seeps between said abutment surfaces during use, said seal comprising a recessed formation disposed in one of said abutment surfaces and a corresponding projection formation disposed on the opposing abutment surface which is adapted to be received within, and form a sealing engagement with, said recessed formation when the abutment surfaces are in contact, wherein said seal defines one or more internally sealed compartments between said abutment surfaces which extend around said inlet and at least a portion of said fluid flow passage.

It will be understood that by "internally sealed compartment" we mean that the seal extends around the inlet and at least a portion of the fluid flow passage defined by the abutment surfaces of the first and second parts such that any fluid that leaks from the inlet or the portion of the fluid flow passage within this compartment and then seeps between the two abutment surfaces is contained within the internally sealed compartment and prevented from leaking out of the nozzle arrangement.

Preferably, the entire length of the fluid flow passage is contained within the one or more internally sealed compartments so that any fluid leaking from any position along the length of the fluid flow passage is contained within the one or more compartments and prevented from leaking from the nozzle arrangement.

In certain embodiments of the invention, it is preferable that the internally sealed compartment or compartments are airtight to prevent any product retained therein from degrading. This is particularly the case when the spray contains a product that is prone to degradation by air, such as, for example, certain food products.

The sealing means may be of any shape. Preferably, however, the sealing means comprises a horseshoe-shaped seal portion of the type described in WO 97/31841 and the one or more internally sealed compartments are formed by the provision of one or more additional sealing barriers. Each additional sealing barrier preferably extends from the horseshoe-shaped seal on each side of the fluid flow passage to a position along the length of the fluid flow passage thereby forming, in combination with the horseshoe-shaped seal, an internally sealed compartment that extends around the fluid inlet and at least a portion of the fluid flow passage. In contrast to the known arrangements that comprise just a horseshoe-shaped seal, the provision of one or more additional sealing barriers to form an internally sealed compartment around the fluid inlet and at least a portion of the fluid flow passage has been found to dramatically reduce, and in most cases eliminate altogether, the leakage of fluid from the nozzle arrangement (including, in particular, the front portion of the nozzle between the two ends of the horseshoe positioned on either side of the outlet).

Preferably, the additional sealing barrier (or barriers) is formed in the same manner as the horseshoe shaped seal (i.e. each barrier comprises a recessed portion formed on one abutment surface that extends from the horseshoe shaped seal on each side of the fluid flow passageway to a position along the length of the fluid flow passageway and a corresponding projection portion formed on the opposing abutment surface which, when the two abutment surfaces are in contact, is received within the recessed formation to form a sealing engagement). The protrusion portions may also be configured to "snap-fit" into the recessed portions to provide a resilient engagement between the two parts.

Preferably, at least one additional sealing barrier extends from the horseshoe-shaped seal on either side of the fluid flow passage to a position which is in close proximity to the fluid outlet to define an internally sealed compartment that surrounds the entire fluid flow passageway. As a consequence, any fluid that leaks out of the fluid flow passage from any position along its length will be contained within the internal compartment and is thus prevented from seeping between the abutment surfaces of the first and second parts and leaking out of the nozzle arrangement.

In some embodiments of the invention only a single internally sealed compartment will be present. However, in certain embodiments of the invention it is preferable to provide multiple internal compartments which surround various portions along the length of the fluid flow passageway to more effectively contain any fluid that leaks from the passageway. In such embodiments, if any fluid leaks from the fluid flow passage at a particular location along its length and then seeps between the abutment surfaces of the first and second parts of the body, the extent of the seepage of the fluid will be confined to the area defined by the internal compartment that surrounds the portion of the fluid flow passage where the leakage occurred. This arrangement of multiple internal compartments can be particularly advantageous because it minimises the volume of fluid leakage at any given location along the length of the fluid flow passageway.

In the preferred embodiments of the invention in which the fluid flow passage comprises one or more internal features, such as those described in WO 01/89958, it is preferable that each individual internal feature positioned along the length of the fluid flow passage is positioned or isolated within a separate internally sealed compartment defined between the abutment surfaces of the at least two parts of the nozzle arrangement.

This is particularly advantageous for a number of reasons. Firstly, the seepage of any fluid that leaks from the fluid flow passage in the vicinity of an individual internal feature will be confined to the internally sealed compartment that surrounds that feature. This minimises the volume of fluid that can leak from the fluid flow passageway, which in turn serves to reduce the effect that the internal leakage has on the performance of the nozzle arrangement and hence, the properties of the final spray ejected from the nozzle arrangement. Secondly, having each individual spray feature positioned within an internally sealed compartment prevents any fluid leaking from, or in the vicinity of, that internal feature from seeping into and flooding another internal feature. Again this enables the other internal features to continue to function properly and hence, effect of any fluid leakage on the properties of the spray ejected from the nozzle to be minimised.

The body comprises at least a first and a second part and, in practice, may comprise multiple parts, each of which may have an abutment surface which comes into contact with the abutment surfaces of the other parts to define the fluid flow passageway and the fluid flow outlet. Each part may be permanently fixed together or, alternatively, one or more parts may be movable with respect to one another to enable the abutment surfaces of the nozzle arrangement to be accessed for cleaning.

In some embodiments of the invention the two parts of the nozzle arrangement will be ultrasonically welded together. This is not an exact process and in practice many areas of the abutment surfaces of the two parts do not actually weld together. This enables the fluid to still leak from the fluid flow passage and seep between the two abutment surfaces. Accordingly, the requirement for an internally sealed compartment still remains. In addition, it has also been discovered that the ultrasonic weld performs best in areas where the two surfaces are forced together in narrow lines. As a consequence, the weld works particularly well in the region of the seal where a recessed formation receiving a correspondingly shaped protrusion portion.

In embodiments of the invention in which it is intended to ultrasonically weld the two parts together, it is preferable to provide a gap between the end or ridge of the protrusion formation and the bottom of the recesses formation so that, in effect, the depth of the recessed formation is greater than the height of the protrusion portion. During the ultrasonic weld process, plastic melts and runs between the two abutment surfaces and this gap becomes filled with molten plastic which, on cooling, solidifies and fills the gap. This improves the seal and also prevents molten plastic flowing into either the fluid flow passage, the fluid inlet or the fluid outlet.

Preferably, the body is hollow unitary moulded plastic body.

The nozzle arrangement is preferably provided with an actuator, which is manually operated to cause the release of the contents of the container to which the nozzle arrangement is fitted to be dispensed. The actuator may be a portion of the nozzle arrangement that can be depressed manually to actuate the release of the contents of the container. In the case of a nozzle arrangement fitted to a pressurised container, such as a so-called aerosol container, the actuator may be a portion of the nozzle arrangement which can be pressed so that an actuator member provided on the nozzle arrangement engages and opens the outlet valve of the container to enable the contents stored therein to be released. Where the container is a non-pressurised container, the nozzle arrangement may be in the form of a pump or trigger device. In the case of a pump device, the actuator is again a portion of the nozzle arrangement which can be pressed to pump the contents of the container to which it is attached through the nozzle arrangement. In the case of a trigger device, the actuator is a trigger, which can be operated to effectively pump the contents of the container through the nozzle arrangement.

According to a second aspect of the present invention there is provided a container having a nozzle arrangement as defined herein fitted to an outlet thereof to actuate the release of the contents stored in said container.

How the invention may be put into practice will now be described, by way of example only, in reference to the following figures, in which.

In the following discussion of the figures, like reference numerals are used to denote like or equivalent parts in different Figures.

Figure 1:
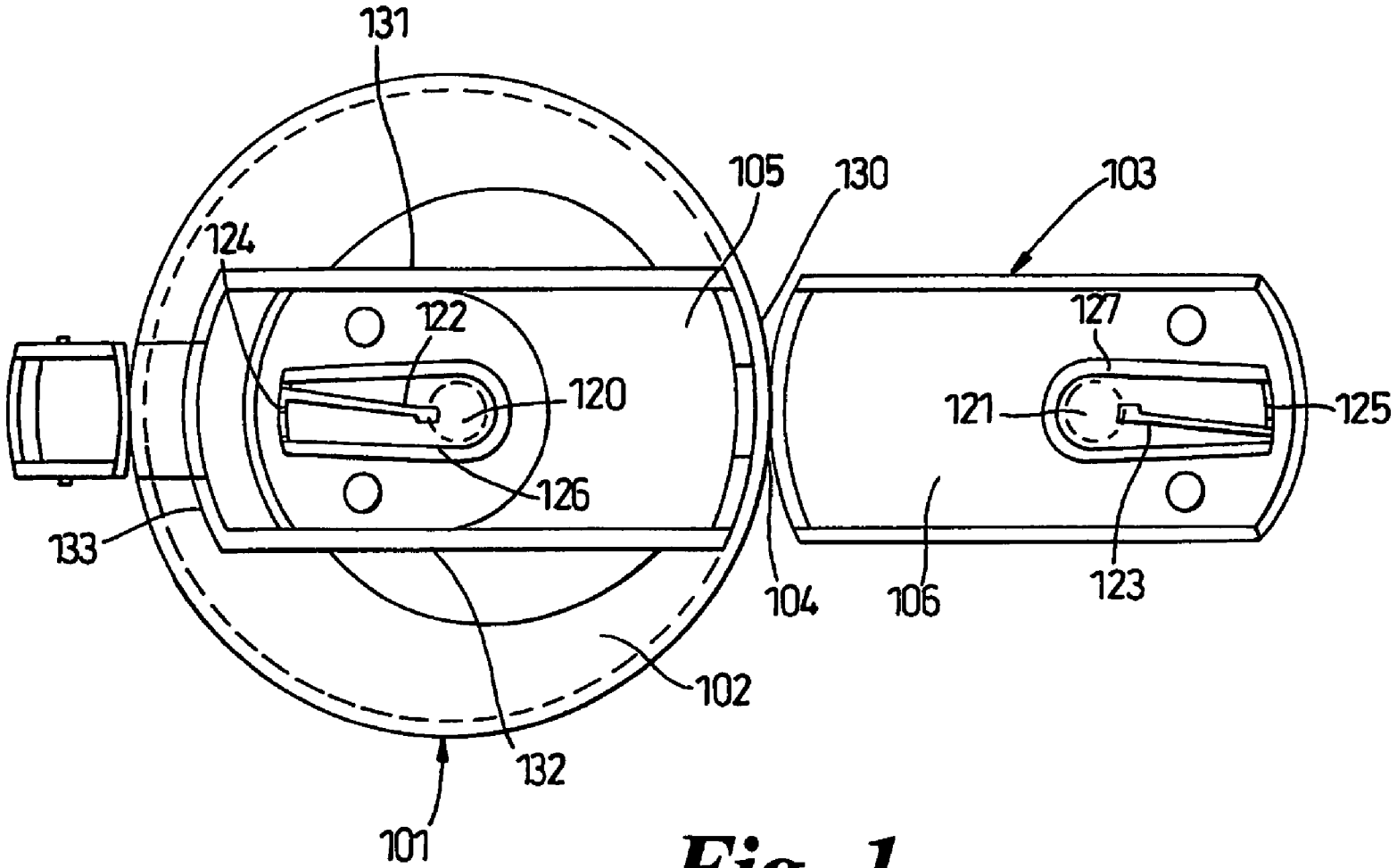
FIG. 1 is a plan view of known nozzle arrangement having a body composed of two parts which are shown in the open position for the purpose of illustration, each of the parts having an abutment surface which defines a fluid flow passageway, a fluid outlet and a "horseshoe-shaped" seal.

FIG. 1 shows a known nozzle arrangement having a body 101 which is of circular cross-section and is adapted to fit to the top of a standard pressurised aerosol canister (not shown). The body 101 is composed of two releasably connectable parts 102 and 103 which are shown in an open (or "separated") configuration in FIG. 1 for the purpose of illustration only. In this configuration the abutment surfaces 105 and 106 of parts 102 and 103 respectively are accessible and this enables the nozzle arrangement to be cleaned if so desired. However, prior to use, it should be appreciated that part 103 is folded over about a hinged joint 104 so that the abutment surface 106 of part 103 is in contact with the abutment surface 105 of part 102. In an alternative embodiment of the invention, parts 102 and 103 are permanently fixed together, for example by ultrasonic welding.

Part 102 of the body 101 has an opening 120 through which fluid from the aerosol canister (not shown) accesses the nozzle arrangement The opening 120 aligns with a recess 121 formed on the abutment surface 106 when the two-parts 102 and 103 are brought together to form a fluid inlet Each abutment surface 105 and 106 additionally comprises grooved formations 122 and 123 respectively, which form a fluid flow passage, which is open to the fluid inlet when the abutment surfaces 105 and 106 are in contact. Each abutment surface 105 and 106 also has a recess, shown as 124 and 125 respectively, which when the abutment surfaces 105 and 106 are brought into contact, define a swirl chamber and an outlet orifice to the fluid flow passage.

A horseshoe-shaped recess 126 is provided on the abutment surface 105. A correspondingly shaped protrusion 127 is also provided on abutment surface 106 and, when the two abutment surfaces are brought together, the protrusion 127 is received within the recess 126 to form a horseshoe-shaped seal around the fluid inlet and the fluid flow passageway.

When the release of fluid from the aerosol canister is actuated during use by the operation of the nozzle arrangement, fluid dispensed from the container to which the nozzle is attached enters the nozzle arrangement through the opening 120 which, together with the recess 121, forms a fluid inlet that directs fluid into the fluid flow passage defined by grooves 122 and 123 respectively. The fluid is then directed into the swirl chamber formed by recesses 124 and 125 of abutment surfaces 105 and 106 respectively, which induces rotational flow in the fluid prior to ejection through the outlet the nozzle assembly.

During use, fluid can leak from the fluid flow passage and seep between the abutment surfaces 105 and 106 of parts 102 and 103. The horseshoe seal prevents fluid from seeping out of the rear 130 and the sides 131 and 132 of the nozzle arrangement. However, this fluid can leak out of the front 133 of the nozzle arrangement and, as previously mentioned, this can affect both the volume of the fluid ejected from the nozzle and the quality (i.e. the spray droplet size and distribution) of the spray produced at the fluid outlet.

Figure 2:
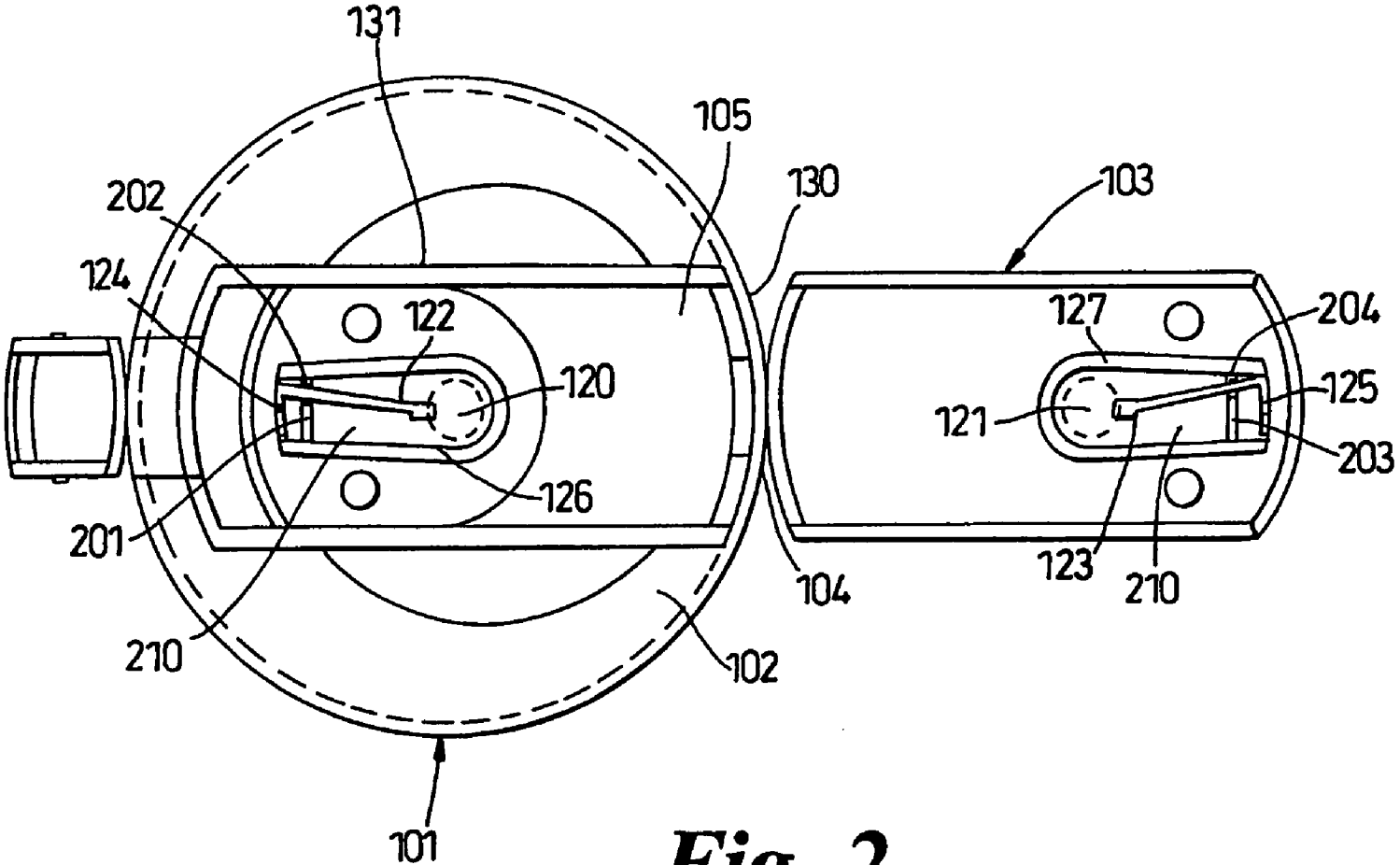
FIG. 2 is a plan view of a first embodiment of a nozzle arrangement of the present of the invention.

A first embodiment of the present invention designed to address this problem is illustrated in FIG. 2. The nozzle arrangement has all the components/formations identified in the description of the nozzle arrangement of FIG. 1, as represented by the like reference numerals shown in FIG. 2. However, the abutment surface 105 additionally comprises protrusions 201 and 202 and the abutment surface 106 is provided with the additional recesses 203 and 204. When the parts 102 and 103 are brought together such that the abutment surfaces 105 and 106 are in contact, the protrusions 201 and 202 provided on the abutment surface 106 are received by, and resiliently engaged within, the recesses 203 and 204 respectively, to form an additional sealing barrier. This sealing barrier extends from the horseshoe-shaped seal to a position on either side of the fluid flow passageway and thus, when the abutment surfaces 105 and 106 are in contact, forms an internally sealed compartment, the area of which is represented by the reference 210 in FIG. 2. In use, the horseshoe-shaped seal prevents any fluid that seeps between the abutment surfaces 105 and 106 from leaking out the rear 130 and the sides 131 and 132 of the nozzle assembly, whereas the additional sealing barrier prevents any fluid escaping from the fluid inlet or the fluid flow passage within the internally sealed compartment (i.e. the area of which is shown by the reference 210) from seeping between the abutment surfaces 105 and 106 and leaking out of the front of the nozzle arrangement.

In alternative embodiments of the invention, more than one additional sealing barrier may be present and the compartment 210 may be subdivided into multiple internally sealed compartments to further minimise the extent of fluid seepage between the abutment surfaces 105 and 106. The compartment 210 may also extend further along the fluid flow passageway to encompass virtually the entire length of the fluid flow passageway and thereby further inhibit the possibility of fluid leaking from the front of the nozzle arrangement.

Figure 3:
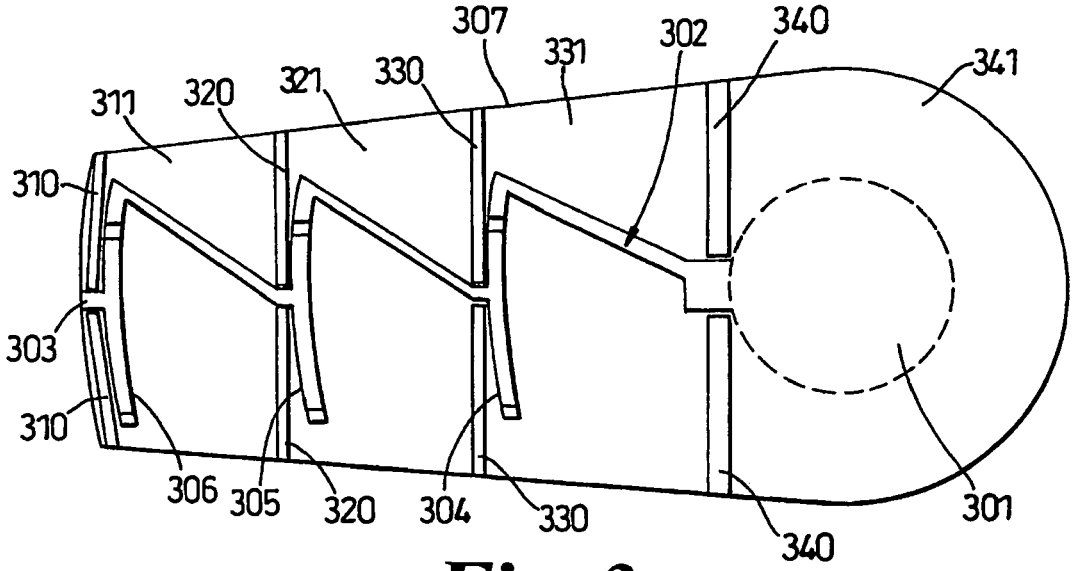
FIG. 3 is a cross-sectional view taken along the plane of the abutment surfaces of an internally sealed compartment of a second embodiment of the present invention.
Figure 4:
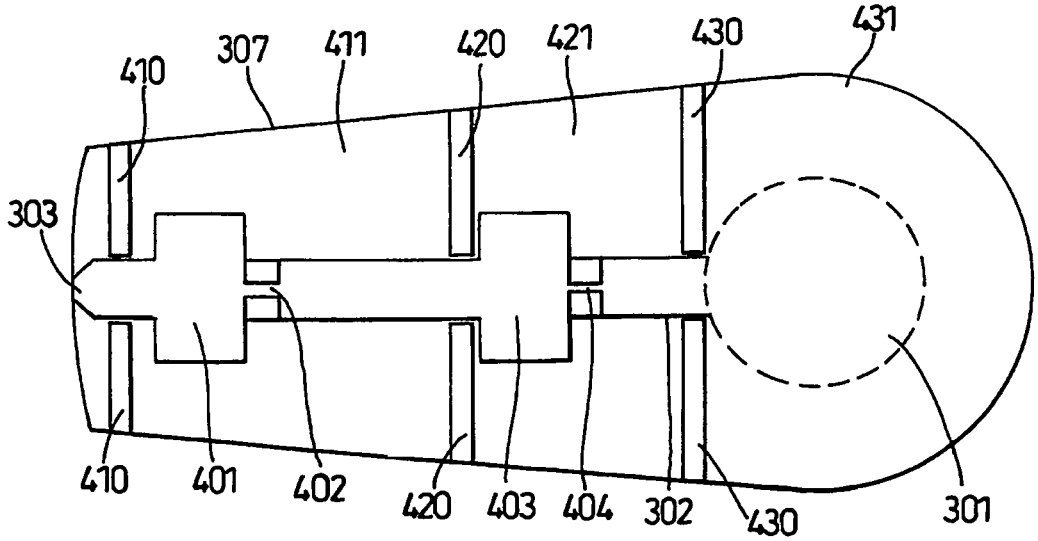
FIG. 4 is a cross-sectional view taken along the plane of the abutment surfaces of an internally sealed compartment of a third embodiment of the present invention.

Two examples of embodiments of the present invention where the internally sealed compartment is divided into multiple internally sealed compartments are shown in FIGS. 3 and 4 respectively. Both of these Figures show a cross-sectional view of the internally sealed compartments of a second and third embodiment of the invention in the closed configuration, i.e. when the two parts (equivalent to 102 and 103 of FIGS. 1 and 2) and their respective abutment surfaces (equivalent to 105 and 106 of FIGS. 1 and 2) are in contact. In both cases, the cross-sectional view is taken along the plane of the abutment surfaces. Referring to FIG. 3, the second embodiment of the invention has a fluid inlet 301, which is formed by formations equivalent to 120 and 121 described in reference to FIGS. 1 and 2. The fluid inlet 301 is open to a fluid flow passageway 302 which connects the fluid inlet 301 to a fluid outlet 303. Positioned along the lengths of the fluid flow passageway 302 are three swirl chambers 304, 305 and 306, which induce rotational flow to the fluid as it passes through the fluid flow passageway during use. Encircling the fluid flow inlet 301, the fluid flow passageway 302 and the fluid Outlet 303 is a horseshoe-shaped seal 307 which is formed by a horseshoe shaped protrusion (equivalent to 127 shown in FIGS. 1 and 2) being received within the horseshoe shaped recess (equivalent to 126 shown in FIGS. 1 and 2).

Extending from either side of the horseshoe shaped seal 307 to the fluid flow outlet 303 is a first sealing barrier 310, which is formed by recessed and protrusion portions in a similar manner to that described in reference to FIG. 2. This first sealing barrier, together with the horseshoe shaped seal, encircles (and hence defines an internally sealed compartment around) the fluid inlet 301 and the entire length of the fluid flow passageway 302, thereby preventing any fluid that leaks from the fluid flow passageway 302 or the fluid inlet 301 from seeping between the abutment surfaces and leaking out of the front, sides and/or rear of the nozzle arrangement. In addition, however, this internally sealed compartment is further sub-divided into four separate internally sealed compartments 311, 321, 331 and 341 respectively, by the additional sealing barriers, 320, 330 and 340, respectively. The internally sealed compartments 311, 321 and 331 each encircle portions of the fluid flow passageway 302 in which a swirl chamber (306, 305 and 304, respectively) is located, whereas the internally sealed compartment 341 surrounds the fluid inlet 301.

This construction is considered to be particularly advantageous because if, for example, any fluid leaked out of the fluid flow passage 302 from the swirl chamber 304, then the seepage of fluid between the two abutments surfaces would be confined to the internal compartment 331 (the seepage of fluid any further being prevented by a combination of the horseshoe seal 307 and the additional sealing barriers 330 and 340). As a result, the seepage of fluid out of the nozzle arrangement is prevented and, in addition, the seepage of fluid into other internal features, in this case the swirl chambers 305 and 306, is also prevented. This minimises the volume of fluid leakage that can occur at any given location and, by preventing the flooding of the other internal features, minimises the effect of the leakage on the properties of the spray produced.

A third alternative embodiment of the present invention is shown in FIG. 4. In this embodiment the fluid flow passageway 302 comprises two inner orifices 402 and 404 which are open to, and generate a spray within the expansion chambers 401 and 403, respectively. Hence, during use, the fluid passing though the fluid flow passage 302 is sprayed through the inner orifice 404 into expansion chamber 403 and then sprayed again through the inner orifice 402 into the expansion chamber 401, prior to ejection of the fluid through the fluid outlet 303.

An internally sealed compartment encircling the fluid inlet 301 and almost the entire length of the fluid flow passageway 302 is formed by a combination of a first sealing barrier 410 and the horseshoe shaped seal 307. This internally sealed compartment is subdivided into three separate compartments 411, 421 and 431, defined by the additional sealing barriers 420 and 430. The portion of the fluid flow passageway 302 comprising the expansion chamber 401 and inner orifice 402 is contained within the internally sealed compartment 411, whereas the expansion chamber 403 and inner orifice 404 are contained within the compartment 421 and the fluid inlet is contained within the compartment 431.

Therefore, as described above in reference to FIG. 3, any fluid leaking from the portion of the fluid flow passageway contained within the internally sealed compartment 421 will be contained therein and prevented from seeping into adjacent compartments by the additional sealing barriers 420 and 430. This minimises the volume of fluid leakage and also prevents the leakage of the fluid swamping the expansion chamber 401 and inner orifice 402 contained in the sealed compartment 411. As a consequence, the inner orifice 402 and the expansion chamber 401 should still be able to perform its function.

The invention claimed is:

1. A nozzle arrangement adapted to be fitted to a container to actuate the release of the contents stored in the container, said nozzle arrangement having a body comprising an outlet through which the contents of the container are ejected from the nozzle arrangement during use; said body being formed from at least a first and a second part, the first part having an inlet through which the contents of the container enter the nozzle arrangement during use and an abutment surface which contacts an abutment surface of the second part, said abutment surfaces defining a fluid flow passage therebetween that connects the inlet to the outlet and a seal that is adapted to contain any fluid that leaks from at least one of the inlet and at least a portion of the fluid flow passage and seeps between said abutment surfaces during use, said seal comprising a recessed formation disposed in one of said abutment surfaces and a corresponding projection formation disposed on the opposing abutment surface which is adapted to be received within, and form a sealing engagement with, said recessed formation when the abutment surfaces are in contact, wherein at least one further projecting formation is provided on one of said parts with a corresponding recessed formation in the other of said parts to form at least one sealing barrier with said seal, wherein said sealing barrier with said seal defines at least one internally sealed compartment between said abutment surfaces which extends around said inlet and at least the portion of said fluid flow passage.

2. A nozzle arrangement as claimed in claim 1, wherein the entire length of said fluid flow passage is contained within said at least one internally sealed compartment so that any fluid leaking from any position along the length of the fluid flow passage is contained with said at least one internally sealed compartment and prevented from leaking from the nozzle arrangement.

3. A nozzle arrangement as claimed in claim 1, wherein said at least one internally sealed compartment is air tight.

4. A nozzle arrangement as claimed in claim 1, wherein said seal comprises a combination of a horseshoe-shaped seal and at least one sealing barrier, said horseshoe-shaped seal extending around said inlet and said fluid flow passage and being formed by a horseshoe-shaped protrusion formed on the abutment surface of one of said parts and a correspondingly shaped recess formed in the abutment surface of said other part that is configured to receive said protrusion when said abutment surfaces are brought into contact, said at least one sealing barrier extending from said horseshoe-shaped seal on either side of the fluid flow passage to a predetermined position along the length of said fluid flow passage so as to form, in combination with the horseshoe-shaped seal, at least one internally sealed compartment.

5. A nozzle arrangement as claimed in claim 4, wherein said at least one sealing barrier is formed by a combination of a recessed formation formed in one of said abutment surfaces that extends from the horseshoe-shaped seal to a position along the length of said fluid flow passage and a corresponding projection portion formed on the opposing surface which is received within, and forms a sealing, engagement with, said recess when the abutment surfaces are brought into contact.

6. A nozzle arrangement as claimed in claim 4, wherein the at least one sealing barrier extends from the horseshoe-shaped seal on either side of the fluid flow passageway to a position in close proximity to the fluid outlet to define an internally sealed compartment that surrounds the entire flow passage.

7. A nozzle arrangement as claimed in claim 1, wherein only a single internally sealed compartment is present.

8. A nozzle arrangement as claimed in claim 1, wherein multiple internally sealed compartments are formed, each internally sealed compartment surrounding a portion of the fluid flow passageway.

9. A nozzle arrangement as claimed in claim 1, wherein said projection formations are configured to snap-fit into said corresponding recessed formations.

10. A nozzle arrangement as claimed in claim 1, wherein said fluid flow passage comprises one or more internal features selected from the group consisting of: one or more inner orifices adapted to generate a spray within the fluid flow passageway; one or more expansion chambers; one or more such chambers; one or more venturi chambers; and one or more sections where the fluid flow passage is divided into one or more separate channels.

11. A nozzle arrangement as claimed in claim 10, wherein each internal feature positioned along the length of the fluid flow passageway is positioned or isolated within a separate internally sealed compartment defined between the abutment surfaces of said first part and second parts of the nozzle arrangement.

12. A nozzle arrangement as claimed in claim 1, wherein said first and second parts are permanently fixed together.

13. A nozzle arrangement as claimed in claim 12, wherein said first and second parts are fixed together by ultrasonic welding.

14. A nozzle arrangement as claimed in claim 1, wherein the body is a unitary moulded plastics body.

15. A container having a nozzle arrangement as claimed in claim 1 fitted to an outlet thereof to actuate the release of the contents stored in the container.

* * * * *